United States Patent [19]

Stadin

[11] Patent Number: 4,972,823

[45] Date of Patent: Nov. 27, 1990

[54] SAFETY STOVE AND BURNER ASSEMBLY

[76] Inventor: Arne H. Stadin, 9043 Angola Rd., Holland, Ohio 43528

[21] Appl. No.: 478,432

[22] Filed: Feb. 12, 1990

[51] Int. Cl.[5] ..... F24C 3/00

[52] U.S. Cl. ..... 126/4; 126/39 J; 126/85 B; 431/352

[58] Field of Search ..... 126/4, 85 R, 85 B, 39 J, 126/39 D, 39 R; 431/352

[56] References Cited

U.S. PATENT DOCUMENTS 3,494,350 2/1970 Perl ..... 126/39 J 3,698,378 10/1972 Rosenberg et al. ..... 126/39 J

*Primary Examiner*—Carroll B. Dority

*Attorney, Agent, or Firm*—Lundy and Walker

[57] ABSTRACT

The safety stove includes a stove body having a heating chamber and an air chamber therein. The stove body and chambers are pneumatically sealed. The heating chamber is positioned between the stove top and the air chamber. A burner assembly is mounted beneath the stove top in the heating and air chambers. The burner assembly has a fuel inlet and an air/fuel mixer and a burner. The burner being in the heating chamber, the fuel inlet being in the air chamber. The air/fuel mixer extending between the chambers. The burner assembly is the sole communication between chambers. The chambers are pneumatically isolated from the body. An air inlet duct communicates with the air chamber and the exterior of the body. A combustion product exhaust duct communicates with the heating chamber and the exterior of the body. The heater chamber and the product exhaust duct define an air/combustion product flow path. A fan is mounted within the air/combustion product flow path. The burner flame is isolated within the body and the flow path is isolated from the exterior of the body. When the stove is used in explosive atmospheres, both the air inlet and the combustion product exhaust ducts communicate with the exterior. In a motorhome or camper application, the air inlet duct may communicate with the interior of the motorhome or camper, if desired.

23 Claims, 4 Drawing Sheets

SAFETY STOVE AND BURNER ASSEMBLY

BACKGROUND OF THE INVENTION

The present invention pertains to a cooking and heating apparatus and more particularly pertains to a safety stove usable in explosive atmospheres and close quarters as in a motorhome, camper or the like and to a burner assembly.

Prior stoves and burners, for use in motorhomes, campers and the like can be generally divided into combustion types and electric types. The combustion type cooking stoves and burners generally utilize a gaseous or liquid fuel, which is burned in an exposed flame. Exposed flames present a fire hazard, and are usually not used for heating in close quarters. Gaseous or liquid fueled heating stoves, alternatively, reduce the fire hazard, by internalizing flames or by using lower heat output catalytic combustion and blocking access to highly heated surfaces. Cooking is impractical, if not impossible, on these stoves. Wood stoves can provide both cooking and heating, but are too heavy to be transportable in a motorhome or camper and have highly heated exteriors, which are dangerous in close quarters.

Combustion type stoves present an additional problem in motorhome and camper use. Water vapor and other combustion gases rapidly build up in confined spaces. Hoods or open windows are a necessity. However, hoods add weight and use additional power. Open windows increase heating requirements.

Prior stoves for use in explosive atmospheres generally are of the low heat output variety wherein utilizing electric burners and blocking access to highly heated surfaces. Gasses or liquid fuel stoves are generally not used.

Electric stoves solve the problems of open flames and combustion gases, but present heavy electrical demands and are highly dangerous in a wet or highly explosive environment. Unless an outside electrical source is available, a motorhome or camper only can supply the high current drain of an electrical stove at the cost of increased weight necessitated by high auxiliary generators or batteries.

It is therefore highly desirable to provide an improved safety stove and an improved burner assembly.

It is also highly desirable to provide an improved safety stove and an improved burner assembly which do not produce an open flame and do not result in heavy electrical demands.

It is also highly desirable to provide an improved safety stove and an improved burner assembly which is safe for use in both cooking and heating in close quarters and explosive atmospheres.

It is also highly desirable to provide an improved safety stove and an improved burner assembly, that vents its combustion gases at moderate temperatures to an exterior environment.

It is also highly desirable to provide an improved safety stove and an improved burner assembly in which outside air may be used for combustion.

It is finally highly desirable to provide an improved safety stove and an improved burner assembly which has all of the above desired features.

SUMMARY OF THE INVENTION

It is an object of the invention to provide an improved safety stove and an improved burner assembly.

It is another object of the invention to provide an improved safety stove and an improved burner assembly, which do not produce an open flame and do not result in heavy electrical demands.

It is another object of the invention to provide an improved safety stove and an improved burner assembly which is safe for use in both cooking and heating in close quarters and explosive atmospheres.

It is another object of the invention of provide an improved safety stove and an improved burner assembly, that vents its combustion gases at moderate temperatures to an exterior environment.

It is another object of the invention to provide an improved safety stove and an improved burner assembly in which outside air may be used for combustion.

It is another object of the invention to provide an improved safety stove and an improved burner assembly which has all of the above desired features.

In the broader aspects of the invention there is provided an improved safety stove and burner assembly. The safety stove includes a stove body having a heating chamber and an air chamber therein. The stove body and chambers are pneumatically sealed. The heating chamber is positioned between the stove top and the air chamber. A burner assembly is mounted beneath the stove top in the heating and air chambers. The burner assembly has a fuel inlet and an air/fuel mixer and a burner. The burner is in the heating chamber. The fuel inlet is in the air chamber. The air/fuel mixer extends between the chambers. The burner assembly is the sole communication between chambers. The chambers are pneumatically isolated from the body. An air inlet duct communicates with the air chamber and the exterior of the body. A combustion product exhaust duct communicates with the heating chamber and the exterior of the body. The heater chamber and the product exhaust duct define an air/combustion product flow path. A fan is mounted within the air/combustion product flow path.

The burner flame is isolated within the body and the flow path is isolated from the exterior of the body. When the stove is used in explosive atmospheres, both the air inlet and the combustion product exhaust ducts communicate with the exterior. In a motorhome or camper application, the air inlet duct may communicate with the interior of the motorhome or camper, if desired. An improved burner assembly is provided for use in the safety stove of the invention.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
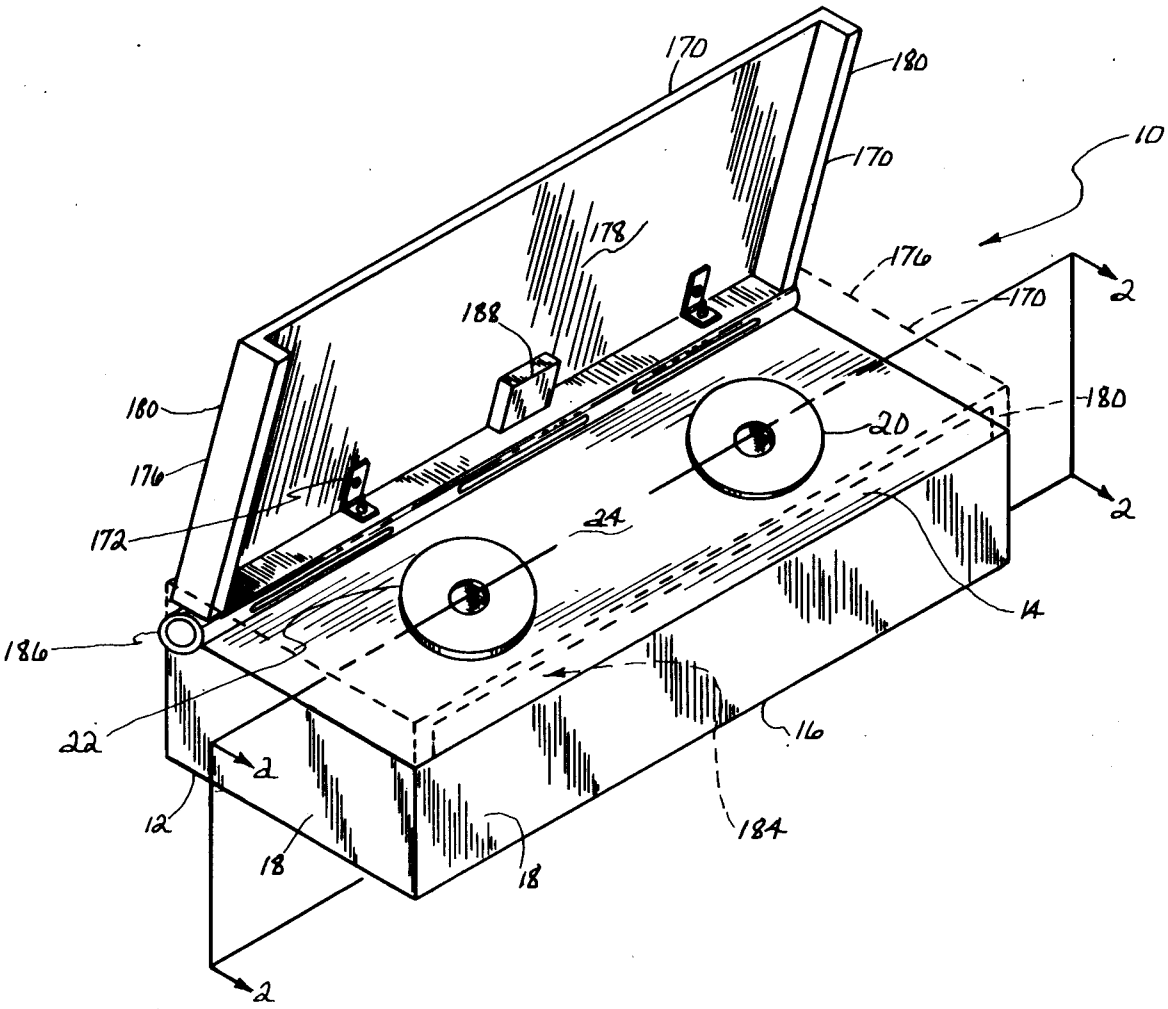
FIG. 1 is a perspective view of the transportable stove of the invention. The cover of safety stove is shown in range position in solid lines and in heater position in dashed lines.

Referring now to FIG. 1 safety stove 10 of the invention is shown to have a body 12, which is generally rectangular. Body 12 has a top 14, a bottom 16, and side panels 18. Top 14 includes a main stove plate 20, an auxiliary stove plate 22 and a periphery 24.

Top 14 is imperforate and plates 20, 22 are continuous with periphery 24. Plates 20, 22 may be welded or otherwise fastened in place. Plates 20, 22 are disk-shaped and are sized to receive cooking implements (not shown). In a specific embodiment, plates 20, 22 are each about six inches in diameter. Plates 20, 22 are preferably made of a highly heat conductive material, and are generally much thicker than periphery 24 in order to spread heat evenly, resist deformation and absorb impacts of cooking implements. In a specific embodiment, periphery 24, side panels 18 and bottom 16 are sheet steel and plates 20, 22 are iron plates of about one-half inch in thickness.

The terms "imperforate" and "perforate" are used herein to refer to the absence or presence, respectively, of open holes extending through a structure.

Figure 2:
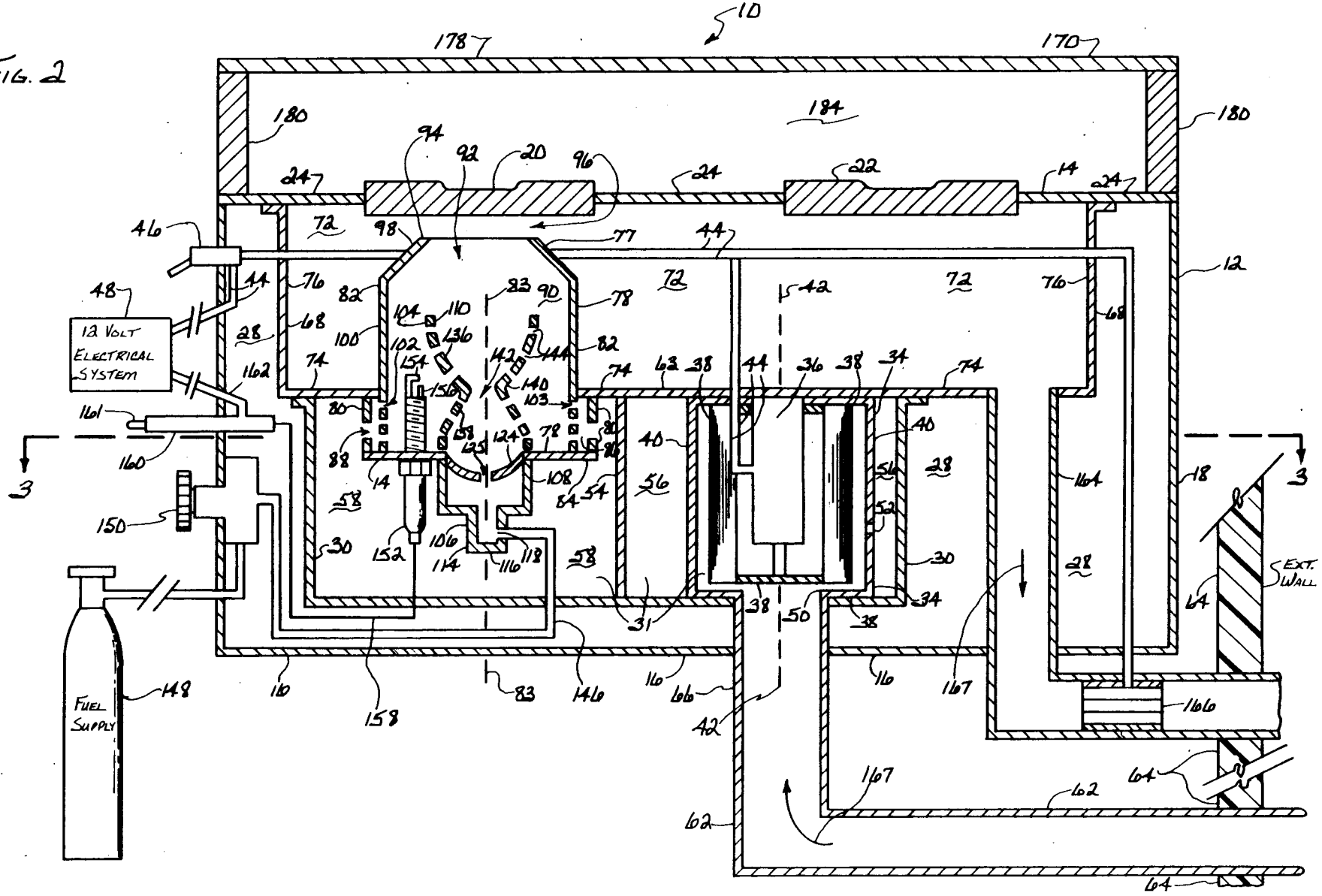
FIG. 2 is a cross-sectional view of the safety stove of FIG. 1 taken essentially along section plane 2—2. The cover is shown in heater position. An electrical system, fuel supply and exterior vehicle wall are all shown diagrammatically.
Figure 3:
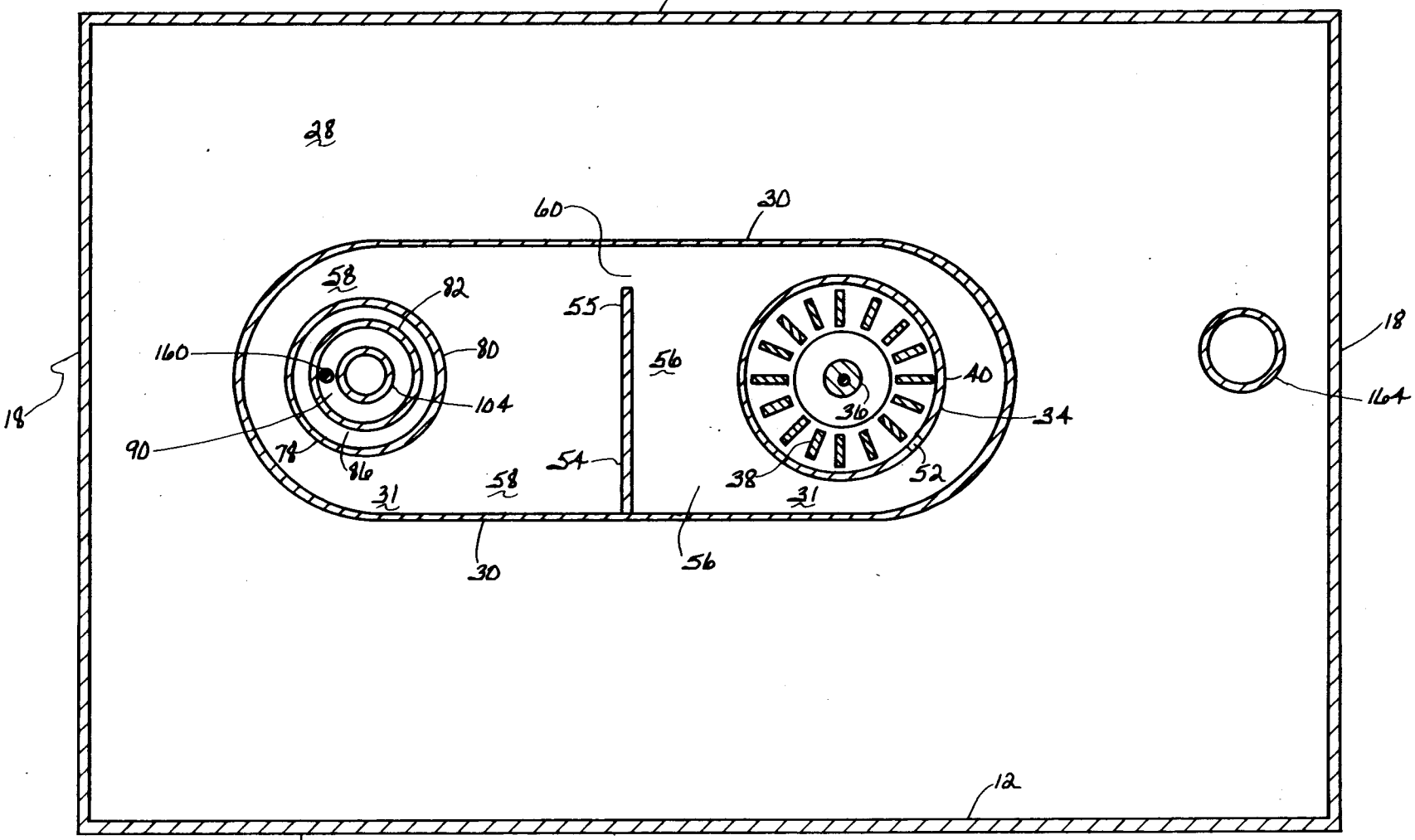
FIG. 3 is a cross-sectional view of the safety stove of FIG. 2 taken essentially along section line 3—3.

Referring to FIGS. 2 and 3, body 12 encloses a body cavity 28. Disposed within body cavity 28 is a primary or air housing 30, the interior of which defines a primary or air chamber 31. A fan 34 is mounted within primary housing 30. Fan 34 includes an electric motor 36, an impeller 38 propelled by motor 36 and a case 40. Case 40 surrounds impeller 38, and motor 36 is mounted to case 40. The axis 42 of rotation of impeller 38 is perpendicular to top 14 and bottom 16. Motor 36 is connected through fan conductors 44, fan switch 46 to electrical system 48. Case 40 completely surrounds impeller 38 except for an intake port 50, which is central and directed downwardly and an exhaust port 52, which communicates with the interior of housing 30. Case 40 is completely enclosed within primary housing 30 with the exception of intake port 50. In a specific embodiment, electrical system 48 is a conventional 12 volt system of a motorhome.

A baffle 54 is disposed within primary housing 30 and defines, together with primary housing 30, an air passage 56 encircling fan 34 and an adjacent air supply chamber 58. Baffle 54 is spaced from primary housing 30 at a free end 55. At free end 55, an air passage opening 60 is defined between primary housing 30 and baffle 54. Air passage 56 communicates with air supply chamber 58 only through air passage 56 at a position opposite air passage opening 60. Fan 34 receives air only through intake port 50 and delivers air only through exhaust port 52 through air passage 56 and air passage opening 60 to air supply chamber 58. In a specific embodiment exhaust port 52 and air passage opening 60 are about 180 degrees from each other.

An air inlet 62 is joined to primary housing 30 at intake port 50 of fan 34. Air inlet 62 extends out through bottom 16 and through wall 64 to the exterior and channels exterior air to intake port 50 of fan 34. In an alternative embodiment of the safety stove 10 of the invention, air inlet 62 is deleted and safety stove 10 utilizes interior air drawn in through an opening 66 in body 12.

A secondary housing 68 is disposed between primary housing 30 and top 14. Secondary housing 68 is welded or otherwise fastened to top 14 and to primary housing 30. Secondary housing 68 defines with top 14, a heating chamber 72, which is contiguous with both plates 20, 22. Secondary housing 68 has a base 74, which adjoins primary housing 30 and upstanding sides 76, which are spaced apart laterally from side panels 18 of body 12.

The burner assembly 77 of the invention is mounted to base 74 of secondary housing 68. Burner assembly 77 has a burner enclosure or air/fuel mixer 78, which extends into air supply chamber 58 and into heating chamber 72 under main plate 20. Burner enclosure 78 is disposed centrally within air supply chamber 58 so that air entering through air passage opening 60 tends to swirl around burner enclosure 78.

Figure 4:
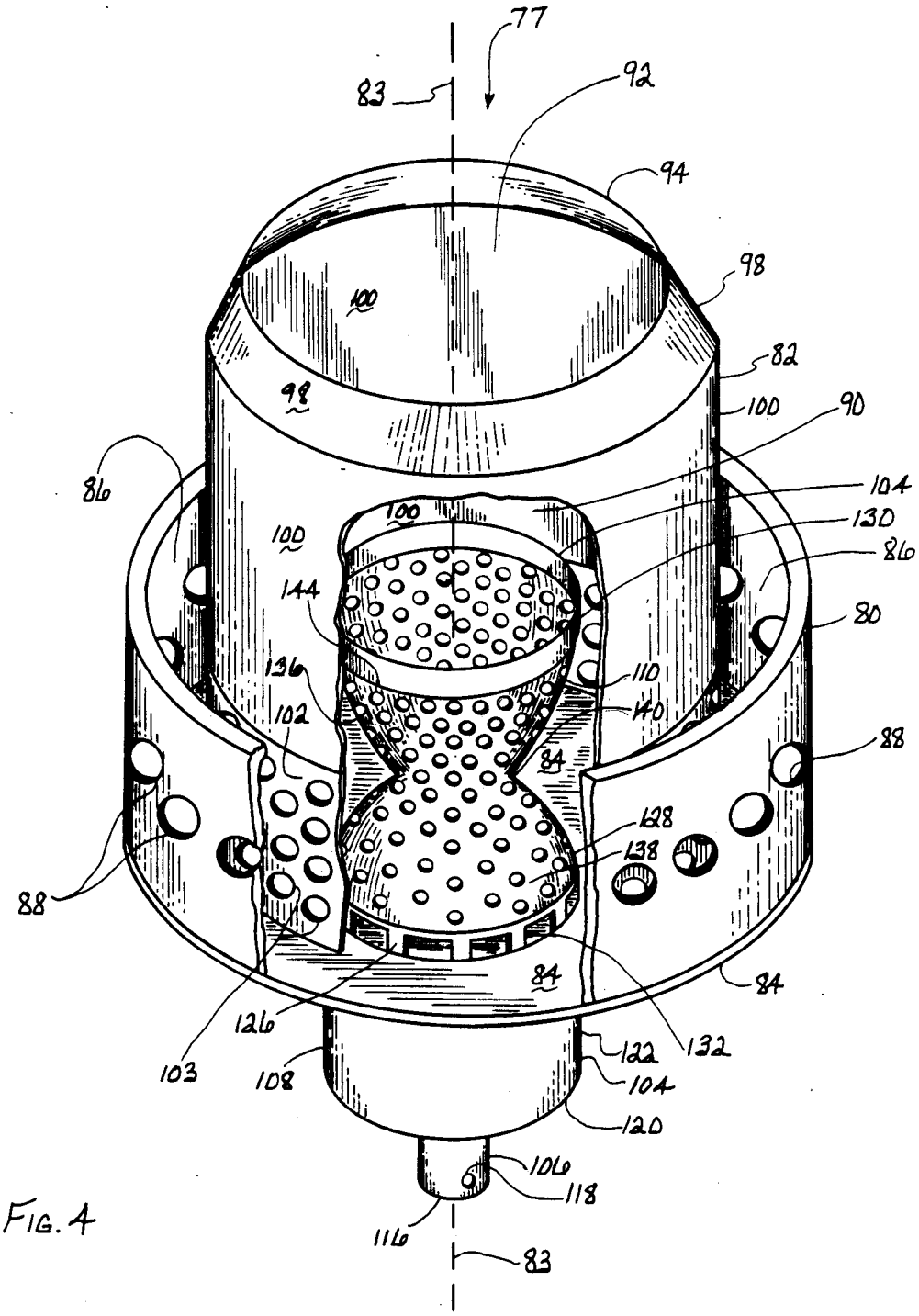
FIG. 4 is a perspective view of the burner assembly of FIG. 1.

Referring now to FIGS. 2, 3 and 4, burner enclosure 78 is shown to have plenum wall 80, an enclosure wall 82 and an end cap 84. Plenum wall 80 extends vertically down from base 74 to end cap 84 and is joined continuously to base 74 and end cap 84. A plenum chamber 86 is enclosed by plenum wall 80, enclosure wall 82, base 74 and end cap 84. Plenum wall 80 is perforated by spaced perforations 88. In a specific embodiment, plenum wall 80 is cylindrical.

Enclosure wall 82 is mounted to base 74. Plenum wall 80, is spaced from enclosure wall 82. Enclosure wall 82 and plenum wall 80 are coaxial about a burner enclosure axis 83. Enclosure wall 82 extends continuously from end cap 84 through base 74 into heating chamber 72. Enclosure wall 82 and end cap 84 define a burner chamber 90, which communicates with heating chamber 72 through a burner chamber opening 92 defined by the upper margin 94 of enclosure wall 82. Upper margin 94 is separated from main plate 20 by a gap 96. In a specific embodiment plenum wall 80 is separated from enclosure wall 82 about one-quarter inch, and upper margin 94 is spaced from main stove plate 20 about one-quarter inch.

Enclosure wall 82 has an upper section 98, a middle section 100 and a lower section 102. Lower section 102 extends between end cap 84 and base 74 and is perforated by perforations 103. In a specific embodiment, perforations 103 are each smaller than perforations 88 in plenum wall 80, and lower section 102 has the shape cf a hollow cylinder about 2 ½ inches in diameter.

Middle section 100 of enclosure wall 82 extends upwardly toward main plate 20 from base 74 and in the embodiment illustrated has the same shape and diameter as lower section 102. Upper section 98 slopes inwardly from middle section 100 to upper margin 94. Both middle section 100 and upper section 98 are imperforate. End cap 84 is secured to both enclosure wall 82 and plenum wall 80. End cap 84 is also imperforate.

A burner 104, which has lower, middle and upper portions 106, 108, 110, respectively, is mounted to end cap 84. Portions 106, 108, 110, of burner 104 are all spaced from enclosure wall 82 and primary housing 30. Lower portion 106 has a lower portion wall 114 closed below by end 116. Lower portion 106 is imperforate except for a fuel inlet 118 extending through lower portion wall 114. Fuel inlet 118 is tangential to lower portion wall 114 in order to promote swirling rather than the linear flow of incoming fuel.

Middle portion 108 has a collar 120 and a middle portion wall 122 closed at one end by collar 120 and lower portion 106. Middle portion 108 is larger in diameter than lower portion 106 to promote continued swirling and expansion of fuel flowing into burner 104. In the specific embodiment illustrated, collar 120 is planar and perpendicular to axis 83 of burner enclosure 78. Middle portion 108 is imperforate and is mounted to end cap 84. Middle portion 108 includes an interior portion 124, which is incurved downwardly from middle portion wall 122 to an opening 125.

Upper portion 110 extends from middle portion 108 away from end cap 84. Upper portion 110 has a perforated section 126, a double conical section 128 and an annular section 130. Perforated section 126 adjoins middle portion 108 and has a ring of perforations.

Double conical section 128 is continuous with section 126 and has the shape of a hollow elliptical hyperboloid. An upper cone 136 joins a lower cone 138 at a neck 140. Neck 140 encloses a central opening 142. Central opening 142 is coaxial with burner enclosure 78. Double conical section 128 has a continuous array of regularly spaced circular perforations 144. Annular section 130 is continuous with double conical section 128 and has the shape of a hollow cylinder. Annular section 130 is imperforate.

Fuel line 146 is connected to fuel inlet 118. Fuel line 146 extends through end cap 84 and body 12 to a fuel supply 148 and includes a manual valve mechanism 150. In a specific embodiment of the invention, the fuel used may be propane gas and fuel supply 148 is a conventional propane cylinder and regulator.

In a specific embodiment of burner 104, lower portion 106 has a lower portion wall 114 which is cylindrical in shape of about one-quarter inch inside diameter, middle portion 108 has a shape of a hollow cylinder of about one inch inside diameter, opening 125 is circular and coaxial with enclosure wall 82 and about three-eights of an inch in diameter, neck 140 is three-eights inch in diameter and annular section 130 is about one and five-eights inches in diameter.

To provide a spark for igniting the fuel, an igniter 152 is mounted on end cap 84 and extends into burner chamber 90. Igniter 152 is an ordinary automotive spark plug and has side and center electrodes 154, 156, respectively. The separation of electrodes 154, 156 from end cap 84 is the same as the separation of neck 140 from end cap 84. In a specific embodiment a five-eights inch spacing is sufficient.

An igniter conductor 158 connects center electrode 154 to a switched ignition coil 160 of the type used in gas grills.

Switched ignition coil 160 is also in electrically conductive contact with body 12 and through body 12 and secondary housing 68 with side electrode 156. Switched ignition coil 160 includes a manual momentary switch 161 which fires coil 160 when pressed. Coil conductors 162 connect switched coil 160 to electrical system 48.

An exhaust duct 164 is connected to secondary housing 68 and joins heating chamber 72 to the exterior through a vehicle wall 64. In a particular embodiment of the invention, an exhaust fan 166, which is connected to fan switch 46, through conductor 44 to electrical system 48, is positioned within exhaust duct 164 to exhaust heating chamber 72 to the exterior. Air inlet duct 62, fan 34, air passage 56, air supply chamber 58, burner assembly 77, including plenum chamber 86 and burner chamber 90, heating chamber 72 and exhaust duct 164 together define an air/combustion product flow path 167 in which the burner flame, air for combustion and combustion gases are isolated from body 12.

Referring again to FIGS. 1 and 2, a cover 170 is joined to body 12 by hinges 172 and can pivot relative to body 12, between a heater position 174, in which cover 170 is lowered and parallel to top 14 and a range position 176, in which cover 170 is raised and set back from top 14. Cover 170 has a cover panel 178, which is flat and has a pair of opposed end flanges 180, which extend out from cover panel 178. In heater position 174, flanges 180 rest on top 14, with cover panel 178 parallel to and spaced from top 14. Cover panel 178 and top 14 define a heater plenum 182. In a specific embodiment, heater plenum 182 has a uniform thickness dimension of about one inch.

A heater plenum opening 184 bounded by top 14, cover panel 178 and end flanges 180 is also defined. The length and width of cover 170 and top 14 are the same, thus when cover 170 is in heater position 174 access to plates 20, 22 is denied except through heater plenum opening 184, which is too small to prevent accidental entry of most flammable materials.

Mounted to cover 170 is a blower 186, at one edge of heater plenum 182 so as to blow air over plates 20, 22 and out of heater plenum 182. A thermostat 188, mounted to cover 170, cycles operation of blower 186. Blower conductors (not shown) connect blower 186 and thermostat 188 to electrical system 48.

In an alternative embodiment of the safety stove 10 of the invention, fan 34, igniter 148, and valve mechanism 150 are all connected to a control unit (not shown), which provides fuel flow only when fan 34 is operating and either igniter 148 is actuated or combustion is occurring. Control units of this type, which may utilize a photoelectric cell to detect combustion and a solenoid controlled valve to provide fuel flow are commonly available for use in gas furnaces used for central heating.

In use, a fuel supply 148, such as a propane gas cylinder is connected to fuel line 146 and electric power is provided for fan 34 and igniter 148. Fan 34 is started, pulling in outside air through air inlet 62 and blowing the air through air passage 56 into air supply chamber 58. The air exiting air passage 56 enters to the side of burner enclosure 78. The flow of fuel through fuel line 146 is started by operation of valve mechanism 150. Fuel enters burner 104 through fuel inlet 118 and is discharged against lower portion wall 114, in order to cause the fuel to swirl within burner 104. Air swirls from air supply chamber 58 through plenum chamber 86 and then into burner chamber 90 where it mixes with the fuel in the vicinity of burner 104. Igniter 148 is energized and ignition of the fuel air mixture occurs. Combustion then continues. The fuel air combustion mixture exits burner chamber 90 and immediately comes into intimate contact with main plate 20 and transfers heat. The combustion mixture continues through heating chamber 72 passing by auxiliary plate 22 and transferring heat. Combustion has ended by this time and the exhaust gases exit through exhaust duct 164. Exhaust gases are sufficiently cool by this time such that single wall pipe may be used for exhaust duct 164 without any danger of igniting a combustible vehicle wall 64.

In a motorhome application, either interior air or exterior air may be fed to burner 104 through inlet air duct 62. In an application where the stove is used in explosive atmospheres, air inlet 62 extends out through bottom 16 and through the wall 64 to the exterior of the building in which the stove is located, and both heating chamber and air supply chamber and the stove body 12 are pneumatically sealed such that the flame is completely isolated from the explosive atmosphere.

The improved safety stove of the invention does not produce an open flame and does not result in large energy demands, is safe to use for both cooking and heating in close quarters and explosive atmospheres, vents its combustion gases at moderate temperatures to an exterior environment, and utilizes exterior air for combustion. The improved safety stove and burner assembly cf the invention provides all of these features while at the same time having all of the properties of gas fired or liquid fuel stoves.

While a specific embodiment cf the invention has been shown and described herein for purposes of illustration, the protection afforded by any patent which may issue upon the application is not strictly limited to the disclosed embodiment; but rather extends to all structures and arrangements which fall fairly within the scope of the claims which are appended hereto:

What is claimed is:

1. A stove comprising a body having a top and a heating chamber and an air chamber, said chambers being within said body, said body and chambers being pneumatically sealed, said heating chamber being between said top and said air chamber, a burner assembly mounted beneath said top in said heating and said air chambers, said burner assembly having a fuel inlet and an air/fuel mixer and a burner, said burner extending into said heating chamber, said fuel inlet being in said air chamber, said air/fuel mixer extending between said chambers, said burner assembly being the sole communication between said chambers, said chambers being isolated from said body, an air inlet duct communicating with said air chamber and the exterior of said body, a combustion product exhaust duct communicating with said heating chamber and the exterior of said body, thereby defining an air/combustion product flow path, and a fan within said air/combustion product flow path, whereby the burner flame is isolated within the body and both said air inlet and combustion product exhaust duct isolate said flow path from the exterior of said body.

2. The stove of claim 1 wherein said air chamber has an air supply chamber and an air passage separated by a baffle.

3. The stove of claim 2 wherein said fuel inlet is disposed within said air supply chamber.

4. The stove of claim 3 wherein said fan adjoins said air passage.

5. The stove of claim 4 wherein said air flow to said burner is controlled by said fan and said baffle.

6. The stove of claim 1 wherein said top forms the upper boundary of said heating chamber, said top having a plurality of stove plates therein, said assembly burner being positioned beneath one of said stove plates.

7. The stove of claim 1 wherein said air inlet extends between said air supply chamber and the exterior of the facility in which said stove is located.

8. The stove of claim 1 wherein said combustion product exhaust extends between said heating chamber and the exterior of the facility in which said stove is located.

9. The stove of claim 1 wherein both said air inlet and said combustion product exhaust communicate between the exterior of the facility in which said stove is located and said air inlet chamber and said heating chamber, respectively.

10. The stove of claim 1 further comprising a cover and a blower, said cover being pivotably connected to said body, said cover being movable between a heater position in which said cover overlays said top in a spaced apart relation and a cooking position, said cover defining with said top a heater plenum between said cover and said top when said cover is in said heating position, said blower being mounted to said cover to move air interior of the facility in which said stove is located through said heater plenum.

11. A stove comprising a body having a top, a primary housing disposed below said top, said primary housing defining an air supply chamber, means for delivering air to said air supply chamber, a secondary housing disposed between top and said primary housing, said secondary housing and said top defining a heating chamber, a burner enclosure extending between said air supply chamber and said heating chamber, said burner enclosure defining a burner chamber extending into said heating chamber, said burner enclosure communicating with said air supply chamber, said burner enclosure being spaced apart from said top, a burner mounted within said burner chamber in spaced relation to said top, a fuel line connected to said burner, and an exhaust duct joined to said heating chamber.

12. The stove of claim 11 further comprising a baffle disposed between said burner enclosure and said means for delivering air.

13. The stove of claim 12 wherein said means for delivering air further comprises a fan disposed within said primary housing, said primary housing and said baffle defining an air passage communicating with said air supply chamber, said fan delivering air to said air passage.

14. The stove of claim 13 further comprising means for forming an air inlet joined to said primary housing, said air inlet extending through said body.

15. The stove of claim 12 wherein said primary housing wall and said baffle define an air passage disposed laterally of said burner enclosure and wherein said air supply chamber communicates with said burner enclosure only through said air passage.

16. The stove of claim 11 wherein said burner enclosure has a burner enclosure wall and an end cap, said end cap and said enclosure wall being imperforate within said heating chamber.

17. The stove of claim 16 wherein said burner has an upper portion, a middle portion and a lower portion, said lower portion and said middle portion extending outwardly of said end cap, said lower portion and said middle portion being imperforate.

18. The stove of claim 17 wherein said upper portion has a double conical section and an annular section, said double conical section being perforate, and generally having the shape of an elliptical hyperboloid having an upper cone, a lower cone and a neck.

19. The stove of claim 18 further comprising an igniter mounted within said burner enclosure, said igniter having a pair of contacts disposed at a vertical separation from said end cap equal to the vertical separation of said neck from said end cap.

20. The stove of claim 11 wherein said burner enclosure has a plenum wall and an enclosure wall, said plenum wall being disposed between said enclosure wall and said air supply chamber, said plenum wall being perforate.

21. The stove of claim 11 further comprising a cover and a blower, and cover being movable between a heater position and a range position, said cover in said heater position being disposed in parallel spaced relation to said top, said cover in said range position being set back from said top, said blower being disposed to blow air between said cover and said top when said cover is in said heater position.

22. The stove of claim 1 further comprising an exhaust fan mounted within said exhaust duct to propel exhaust gases outwardly.

23. A burner assembly comprising and end cap, a plenum wall contiguous with said end cap, said plenum wall being perforate, an enclosure wall disposed within said plenum wall in spaced relation to said plenum wall, said enclosure wall being contiguous with said end cap, said enclosure wall having an upper section and a middle section and a lower section, said upper section and said middle section each being imperforate, said upper section having an upper margin sloped inwardly from said middle section, said lower section having the same vertical dimension as said plenum wall, said lower section being perforate, and a burner mounted to said end cap, said burner having an upper portion and a middle portion and a lower portion, said upper portion being perforate, said middle portion and said lower portion each being cylindrical and coaxial, said middle portion having a larger diameter than said lower portion, said lower portion having a lower portion wall and an end, said lower portion wall having a fuel inlet therein.

* * * * *